United States Patent [19]

Eisbein et al.

[11] 4,239,375

[45] Dec. 16, 1980

[54] IMAGE CARRIER DRUM FOR AN ELECTROPHOTOGRAPHIC COPIER

[75] Inventors: Jürgen Eisbein; Helmut Wegmann, both of Gerlingen, Fed. Rep. of Germany

[73] Assignee: Develop Dr. Eisbein GmbH & Co., Fed. Rep. of Germany

[21] Appl. No.: 76,815

[22] Filed: Sep. 19, 1979

[30] Foreign Application Priority Data

Sep. 20, 1978 [DE] Fed. Rep. of Germany ..... 2840891

[51] Int. Cl.[3] ..... G03G 15/00

[52] U.S. Cl. ..... 355/16; 242/67.3 R; 355/3 DR

[58] Field of Search ..... 355/16, 3 DR, 3 R; 29/123; 242/67.3 R

[56] References Cited

U.S. PATENT DOCUMENTS

| | | | |
|---|---|---|---|
| 3,974,974 | 8/1976 | Nishikawa | 355/16 X |
| 4,102,570 | 7/1978 | Shimoda | 355/16 |

*Primary Examiner*—R. L. Moses

*Attorney, Agent, or Firm*—Craig & Antonelli

[57] ABSTRACT

A drum for an electrophotographic copier which serves as an intermediate image carrier which drum is rotatably mounted in the copier and includes a takeup roll and a supply roll with photoconducting material, in the form of a web, being guided from the supply roll over a deflection roll outwardly to the surface of the drum and over a second deflection roll to the takeup roll. The takeup roll is adapted to be coupled to a drive motor disposed outside of the drum for a stepwise feed of the photoconducting material. The drum is rotatably mounted by two pins with one of the pins being rotatable circumferentially relative to the drum and being non-rotatably connectable with a gear meshing with a further gear mounted on the takeup roll. The one pivot pin is connected by a freewheel mechanism to a drive motor which, in normal operation, drives another component of the copier with the rotational direction of the drive motor being reversible in order to drive the one pivot pin.

14 Claims, 4 Drawing Figures

IMAGE CARRIER DRUM FOR AN ELECTROPHOTOGRAPHIC COPIER

The present invention relates to a drum and, more particularly, to an intermediate image carrier drum for an electrophotographic copier, which drum is rotatably mounted in the copies and internally accommodates a takeup roll and a supply roll for photoconductive material in a web form which material is guided from the supply roll over a deflection roller outwardly onto an outer surface of the drum and then over a second deflection roller to the takeup roll, which takeup roll is adapted to be coupled to a motor drive disposed outside of the drum for a stepwise feed of the web of semiconductor material.

In German Auslegeschrift 15 22 151, a drum of the aforementioned type is proposed which includes a gear adapted to match with a gear on the takeup roll and simultaneously with a gear of a feed roller pair also disposed in the drum. The outer gear is adapted to be coupled with a drive motor whose "on" time is controlled by a cam provided on the drive shaft of the drum. Additional transport rollers are required since the "on" time is constant and, otherwise, unequal lengths of semiconductor material would be fed from the supply roll, that is, as a function of the fullness or takeup roll. Moreover, an additional drive motor must be provided to provide the drive to feed the semiconductor material.

The aim underlying the present invention essentially resides in providing an intermediate image carrier drum for electrophotographic copier which includes a motor for controlling the movement of a semiconductor material on the outer surface of the drum without considerably increasing the design and construction costs of the drum.

In accordance with advantageous features of the present invention, the drum, serving as an intermediate image carrier, is rotatably mounted on two pivot pins with one of the pivot pins being rotatable circumferentially relative to the drum and the other being non-rotatably connectable with a gear mounted in the drum, which gear meshes with a gear connected to the takeup roll. The pivot pin is adapted to be connected to a drive motor by way of a freewheel arrangement with the freewheel arrangement including as the drive motor a motor which drives another component during a normal operation of the copier, with the rotational direction of the motor being reversible in order to drive the pivot pin.

By virture of the above features of the present invention, it is ensured that, in a very simple manner from the design standpoint, that a motor can be used to feed the semiconductor material to the outer surface of the drum without requiring a separate drive motor. Additionally, the switching and control of such motor can be incorporated with extreme simplicity into the overall circuit of the copier.

In accordance with the present invention, a brake arrangement is provided for braking the drum so as to prevent the drive feeding the semiconductor material from turning the drum thereby leading to errors in the length of material fed.

In order to ensure that the drum turns with the pivot pin during a normal operation and that there is no relaxation of the web semiconductor material resting upon the outer surface of the drum, advantageously, in accordance with further features of the present invention, the takeup roll is connected to a spring element which exerts a torque in the winding direction with the spring element being, for example, a coil spring which is wound in a manner similar to that used in clocks so that, even after a complete web of semiconductor material has been wound up, a sufficient tension will still be present acting upon the web of the semiconductor material.

In accordance with further features of the present invention, a measuring and switching device is mounted interiorly of the drum in order to measure the length of the semiconductor material fed from the supply roll to the takeup roll and also to interrupt the drive of the takeup roll. By virtue of such features, an exact measurement of the necessary length of the semiconductor material web is permitted without having to provide additional drive elements inside the drum.

The measuring and switching device of the present invention may be connected to one of two deflection rollers and may include a trip cam or trip actuator driven by a deflection roller with the cam being associated with a switch. The drive used for this arrangement can be easily disposed in such a manner that an exact length of semiconductor material can be fed and wound up on the takeup roll.

In order to be able to connect the switch of a measuring and switching device to the control system of the copier unit, in accordance with additional advantageous features of the present invention, the switch is connected to the copier control system through a slip ring mounted on the end of the drum and a stationary contact pin in contact with the slip ring.

Advantageously, a brake shoe, mounted in such a manner that it is insulated from the copier, serves as the contact pin with the brake shoe being pressed against the slip ring by a spring force. In this manner, in a highly advantageous fashion, a combination of the contact pin and the likewise necessary braking device is obtained.

The gear non-rotatably connected to one of the pivot pins and the gear mounted on the takeup roll are, in accordance with the present invention, advantageously mounted in recesses in an end wall of the drum. Accordingly, it is an object of the present invention to provide a drum for an electrophotographic copier serving as an intermediate image carrier which avoids, by simple means, shortcomings and disadvantages encountered in the prior art.

Another object of the present invention resides in providing a drum for an electrophotographic copier serving as an intermediate image carrier which is simple in construction and therefore relatively inexpensive to manufacture.

Another object of the present invention resides in providing a drum for an electrophotographic copier which ensures an accurate and precise feeding of webs of semiconductor material along the outer surface of the drum.

Yet another object of the present invention resides in providing a drum for an electrophotographic copier serving as an intermediate image carrier by which webs of semiconductor material may be advanced over the outer surface of the drum without providing an additional drive means.

A still further object of the present invention resides in providing a drum for an electrophotographic copier serving as an intermediate image carrier which ensures the proper tensioning of a web of semiconductor material over the outer surface of the drum.

Another object of the present invention resides in providing a drum for an electrophotograhic copier serving as an intermediate image carrier which functions realiably under all operating conditions.

These and other objects, features, and advantages of the present invention will become more apparent from the following description when taken in connection with the accompanying drawings which show, for the purposes of illustration only, one embodiment in accordance with the present invention, and wherein.

Figure 1:
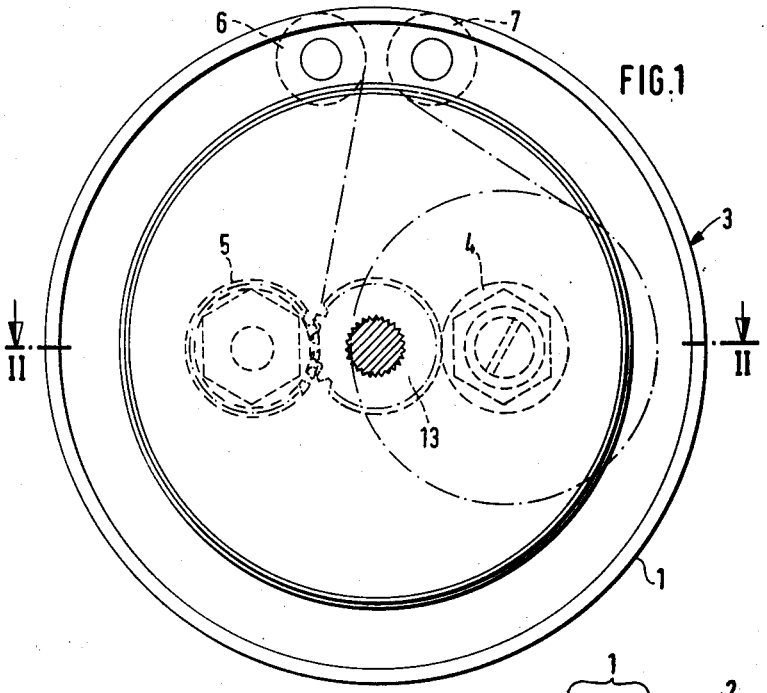
FIG. 1 is an end view of an intermediate image carrier drum for an electrophotographic copier in accordance with the present invention.

Referring now to the drawings wherein like reference numerals are used throughout the various views to designate like parts and more particularly, to FIG. 1, according to this Figure, a drum, serving as an intermediate image carrier in an electrophotographic copier, includes an outer surface which is coated or on which is disposed a semiconductor or photoconducting material 1 which is adapted to pass individual copying stations at which an image is produced during the course of one revolution of the drum in a conventional manner. Initially, the photoconducting or semiconductor material 1 is given a uniform electrostatic charge and then the drum is partially discharged by exposure corresponding to the pattern of the object to be copied so that a charge pattern corresponding to the object is obtained. A toner image is developed on this charge pattern and is then transferred to a sheet of paper or the like onto which the toner image is fixed in a conventional manner.

Figure 2:
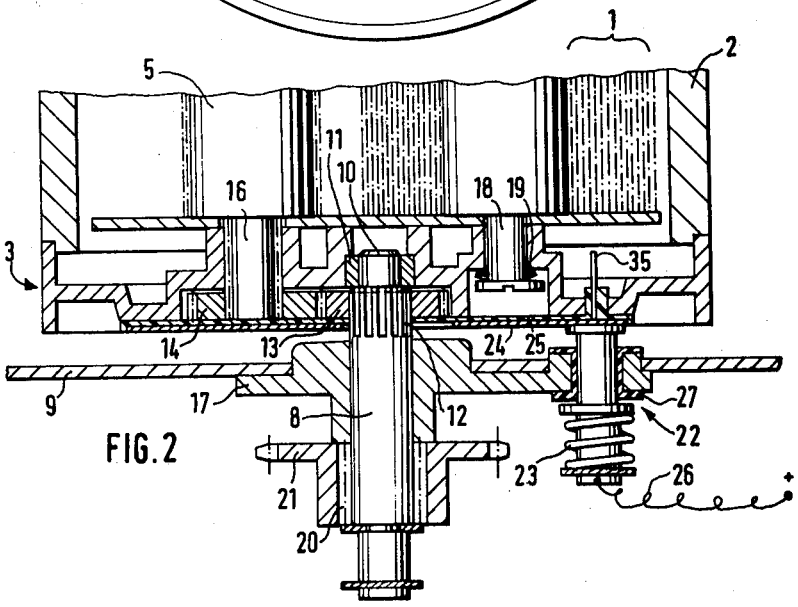
FIG. 2 is a partial cross-sectional view taken along the line II—II in FIG. 1 and through a portion of a corresponding housing of an electrophotographic copier in which the drum is arranged.

As shown most clearly in FIG. 2, the drum includes a cylinder 2, closed at both ends by end walls generally designated by the reference numberal 3, only one of which is shown in the drawings for the sake of clarity. A supply roll 4 and takeup roll 5 are mounted interiorly of the drum and the cylinder 2 is provided with an axial slot defined by two deflecting rolls 6, 7 (FIG. 1).

Photoconductor or semiconductor material, in web form, is wound on the supply roll 4 and is adapted to be fed from the supply roll 4 out through the slot defined by the rolls 6, 7 over the deflection roll 7 around the outer surface of the cylinder 2 and back around to the deflection roller 6, after which the material 1 is fed into the slot and connected to the takeup roller 5. The semiconductor material 1 is unwound from the supply roll 4 and is then wound up on the takeup roll 5.

As can readily be appreciated, the semiconductor material 1 does not have an unlimited lifetime and, consequently, the quality of copies which can be obtained shows a definite decline after a certain number of copying cycles such as, for example, about 750 copies. After the completion of such a copying cycle, in order to obtain perfect copies, the area which has been located on the outside of the surface of the drum is then wound up on the takeup roll 5 and replaced by an area of material 1 which is unwound from the supply roll 4.

The drum itself is mounted on two pivot pins, only one of which is shown in the drawings, which pins are axially displaceably mounted in a wall 9 of the housing of the copier with the pivot pins engaging end walls 3 of the drum. The pivot pin not shown in the drawing is nonrotatably connected to the corresponding end wall 3 and is also connected to a rotary drive (not shown) which transmits a rotational movement to the drum normally required for the copying process.

The pivot pin 8 shown in FIG. 2 is mounted in a bearing insert 17 inserted in the wall 9 of the copier housing and has a tip 10 inserted into a slide bearing 11 fitted in the end wall 3. The pin 10 is provided with serrations 12 which enable the pivot pin 8 to mesh with a corresponding internal toothing provided on a gear 13. The gear 13 is provided with external toothing which meshes with another gear 14 non-rotatably connected to a shaft 16 which mounts the takeup roll 5 in the drum. Thus, the takeup roll 5 can be driven by rotation of a pivot pin 18 which normally turns together with the drum.

The supply roll 4 is mounted on a shaft 18 mounted in the end wall 3 with a leaf spring stack 19 subjecting the shaft 18 to an axial tension so that a specific force must be overcome in order to turn the supply roll 4 about its axis of rotation. The shaft 16 of the takeup roll 6 is tensioned by a coil spring (not shown) with the coil spring exerting a torque on the shaft 16 which acts in a feed direction of the supply roll 4 and in a wind up direction of the takeup roll 5. The resultant forces are so dimensioned such that the forces do not reach the forces required to turn the supply roll 4 but rather such forces simply maintain the semiconductor material 1, in web form, realiably tensioned on the outer surface of the drum and the semiconductor material 1 can only be fed from the supply roll 4 when additional forces are exerted on the takeup roll, which additional forces are exerted through the pivot pin 8 in a manner described more fully hereinbelow.

The pivot pin 8 is connected to a chain wheel or gear 21 through a freewheel arrangement 20. A chain (not shown) extends over the chainwheel 21 and is adapted to be driven by a drive motor (not shown).

The drive motor for driving the chain and chainwheel 21 may be a drive motor already provided for another drivetrain in the copier such as, for example, a drive motor for the paper feed of the copier. The connection between the drive chain and drive motor is such that, during normal operation of such drive motor, i.e., during normal paper feed, the chainwheel 21 idles and does not drive the pivot pin 8 through the freewheel arrangement 20. Consequently, the pivot pin 8 is only driven when the rotational direction of the drive motor, provided with a corresponding switch, is reversed so that the pivot pin 8 then drives the shaft 16 of the takeup roll 5 through gear 13 and gear 14 thereby unwinding the semiconductor material 1 from the supply roll 4 and winding it up on the takeup roll 5.

The freewheel arrangement 20 is constructed so that it exerts a zero torque between the chainwheel 21 and pivot pin 8 in the normal operating rotational direction of the drum and pivot pin, which direction would be counterclockwise in FIG. 1. The pivot pin 8 is only driven when the chainwheel 21 is driven in the opposite direction, i.e., clockwise in FIG. 1.

As can readily be appreciated, a corresponding free wheel arrangement is provided in the drive train for which the drive motor is normally provided, i.e., the paper feed of the copier. Such additional free wheel arrangement is provided so that, upon reversing of such drive motor, the drive is not driven in the opposite direction when the semiconductor material is unwound, at which time the drive motor turns in a direction opposite to its normal operational rotational direction.

In order to ensure that the pivot pin 8 only drives the shaft 16 of the takeup roll 5 through gears 13 and 14 and not the entire drum, a brake device 22 is provided which is adapted to brake the drum at least during the deployment of the semiconductor material 1, in web form, to an adequate degree.

For this purpose, a spring loaded bolt 23 is provided with the bolt 23 being pressed against a slip ring 24 mounted on an insulating plate 25 on end walls 3 of the drum. The spring loaded bolt 23, connected to a source of electricity by a wire lead 26, is mounted in an insulating fitting in the bearing part 17.

The programmed control means of the electrophotographic copier advantageously provides that the number of copies to be made is counted by a counter which may determine the number of copies made since the semiconductor material 1, in web form, was deployed on the drum. Above a certain number of copies, such as, for example, 750 copies, a signal light (not shown) may be illuminated to alert the user that it is time to change the portion of the semiconductor material 1 which is on the surface of the drum. The operator of the electrophotographic copier can decide whether the quality of copies produced is still adequate even after the predetermined number of copies, i.e., 750 copies, has been reached and, if desired, the operator can wait before advancing the semiconductor material.

If the operator decides the quality of the copies is not adequate, the operator then pushes a push switch (not shown) thereby causing the drive motor of, for example, the paper feed of the copier, to be connected to the chain wheel 21 with the drive motor being driven in a rotational direction which is opposite to the normal direction of rotation thereof. The drive motor is actuated until a predetermined length of semiconductor material 1 corresponding to the outer surface of the cylinder 2 which is covered by the semiconductor material 1 has been unwound from the supply roll 4.

Figure 3:
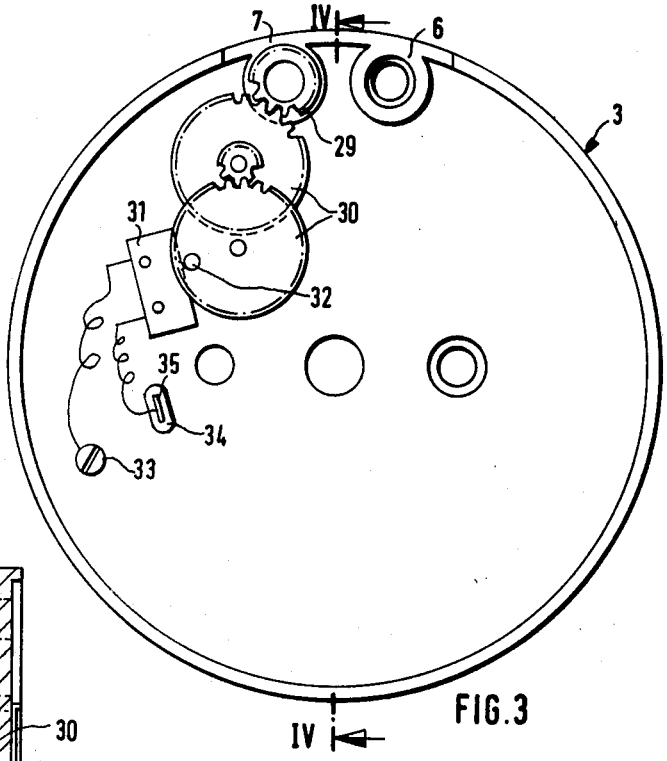
FIG. 3 is an internal view of the drum of the present invention in a direction toward one end wall.
Figure 4:
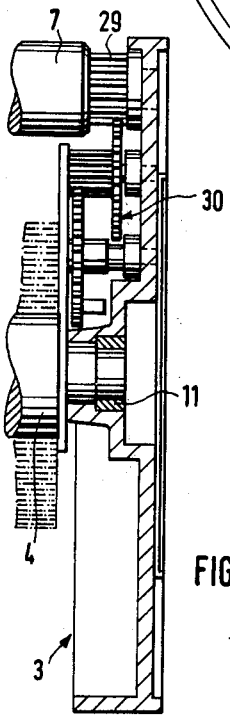
FIG. 4 is a partial cross-sectional view taken along the line IV—IV in FIG. 3.

In order to determine that a proper length of semiconductor material 1 has been deployed and then give an appropriate switching or control pulse, a measuring or switching means such as shown in FIGS. 3 and 4 is disposed interiorly of the drum. The measuring and switching means is driven off a toothed segment 29 of the deflection rolls 7. The rotary motion of the deflection roll 7 is then transmitted through a gear train 30 to a microswitch 31. The toothed segment 29 of the deflection roller 7 and gear train 30 have a transmission ratio designed so that the length of semiconductor material 1 which extends between the two deflection rolls 6, 7 over the outer surface of the cylinder 2 corresponds to one revolution of the last gear in the gear train 30 which last gear is provided with a contact bolt or tripping cam 32 for actuating a microswitch 31 after a completion of one revolution. The microswitch 31 is connected to the drive motor so as to shut off the drive to the pivot pin 8 upon completion of one revolution of the last gear in the gear train 30.

As shown in FIG. 4, the gear train 30 is mounted on the back of an end wall 3 inside of the drum. The microswitch 31 is grounded to the end wall 3 by a terminal 33 and has another terminal 34 connected to a tab 35 on slip ring 24 (FIG. 2) with the slip ring 24 being connected to the machine control system by way of the brake or spring loaded bolt 23.

The electrophotographic copier is equipped with a conventional microprocessor (not shown) to which the switching steps of the microswitch 31 are supplied in the form of pulses with the microprocessor determining how often the area of the semiconductor material 1 on the outer surface of the drum has already been renewed and comparing such value with the amount still available on the supply roll 4. When the counter of the microprocessor determines that the supply roll 4 has been used up, an appropriate signal such as, for example, an illumination of a lamp on the electrophotographic copier, indicates that it is time to change the drum.

While we have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

We claim:

1. An intermediate image carrier drum for an electrophotographic copier, the drum being rotatably mounted in the copier and comprising a web of photoconducting material adapated to be arranged on an outer surface of the drum, a supply roll means for accommodating a supply of the photoconducting, a takeup roll means for receiving the photoconducting material from the supply roll means, the supply roll means and the takeup roll means being rotatably mounted in an interior of the drum, means for guiding the photoconducting material from the supply roll means out of the interior of the drum and along an outer surface of the drum to the takeup roll means, and means for coupling the takeup roll means to a drive means so as to enable a stepwise fed of the photoconducting material, characterized in that a pair of pin means are provided for rotatably mounting the drum in the copier, one of said pin means being circumferentially rotatable relative to the drum, a gear means is non-rotatably connected with said one of said pin means, the coupling means includes a further gear means mounted on the takeup roll means in meshing engagement with said gear means, a free wheel means is interposed between said one of said pin means and the drive means, and in that said drive means is a reversible drive motor which, in a first direction of rotation drives another component of the copier and in an opposite direction of rotation drives said one of said pin means.

2. An intermediate image carrier drum according to claim 1, characterized in that the guiding means includes a pair of deflection roll means defining therebetween a slot through which the web of photoconducting material passes from and into the interior of the drum.

3. An intermediate image carrier drum according to claim 2, characterized in that the drive means further includes a drive gear mounted on said one of said pin means, and in that said freewheel means is interposed between said drive gear means and said one of said pin means.

4. An intermediate image carrier drum according to claim 3, characterized in that means are provided for braking said drum so as to prevent said one of said pin means from rotating the drum.

5. An intermediate image carrier drum according to claim 4, characterized in that means are provided for exerting a torque on the takeup roll means in a wind up direction.

6. An intermediate image carrier drum according to claim 5, characterized in that said means includes a spring.

7. An intermediate image carrier drum according to claim 5, characterized in that a recess means is provided in an end wall of the drum for accommodating said gear means and said further gear means.

8. An intermediate image carrier drum according to one of claims 4 or 7, characterized in that means are provided for measuring a length of the photoconducting material fed from the supply roll means and for interrupting a drive of the takeup roll means upon a deployment of a predetermined length of the photoconduction material.

9. An intermediate image carrier drum according to claim 8, characterized in that said last mentioned means includes a switch means operatively connected with the drive motor, and a cam means is connected to one of the deflector roll means for tripping said switch means to interrupt the drive of the takeup roll means.

10. An intermediate image carrier drum according to claim 9, characterized in that a slip ring means is mounted on an end of the drum and is operatively connected with said switch means, and in that a stationary contact pin means in contact with the slip ring means operatively connects the slip ring means with a control means of the copier.

11. An intermediate image carrier drum according to claim 10, characterized in that the contact pin means form a brake shoe of said braking means, and in that a spring means is provided for urging the brake shoe into contact with the slip ring means.

12. An intermediate image carrier drum according to one of claims 1, 2, 3, or 4, characterized in that means are provided for exerting a torque on the takeup roll means in a wind up direction.

13. An intermediate image carrier drum according to one of claims 1, 2, 3, 4, or 5, characterized in that a recess means is provided in an end wall of the drum for accommodating said gear means and said further gear means.

14. An intermediate image carrier drum according to one of claims 1, 2, 3, 4, 5, or 7, characterized in that means are operatively connected with said guide means for measuring a deployment of a predetermined length of the photoconducting material and for switching off the drive means upon a deployment of the predetermined length of photoconducting material.

* * * * *